United States Patent [19]

Tasaki et al.

[11] 4,216,883

[45] Aug. 12, 1980

[54] CONSTRUCTION FOR SUPPORTING ATOMIZING MEANS OF MANUALLY OPERABLE ATOMIZER

[75] Inventors: Takaharu Tasaki; Shigeo Iizuka; Tadao Saito, all of Tokyo, Japan

[73] Assignee: Yoshino Kogyosho Co., Ltd., Tokyo, Japan

[21] Appl. No.: 924,231

[22] Filed: Jul. 13, 1978

[30] Foreign Application Priority Data

Aug. 20, 1977 [JP] Japan ..... 52-111639[U]
Mar. 20, 1978 [JP] Japan ..... 53-35921[U]

[51] Int. Cl.[2] ..... B05B 9/043
[52] U.S. Cl. ..... 222/321; 239/333
[58] Field of Search ..... 222/321, 385, 402.1, 222/402.13, 402.15; 239/331, 333

[56] References Cited

U.S. PATENT DOCUMENTS 3,120,328 2/1964 Corsette et al. ..... 222/321
4,053,089 10/1977 Gamadia ..... 222/321
4,071,173 1/1978 Horan ..... 222/321
4,132,359 1/1979 Nozawa ..... 222/321 X

*Primary Examiner*—F. J. Bartuska

[57] ABSTRACT

In a manually operable atomizer wherein a piston is operated through an atomizing head, so as to cause a pumping action to suck up the liquid from a liquid container and then pressurize the liquid to atomize the same through a nozzle, a flange is provided to extend outwardly from the wall of a cylinder of an atomizer. The flange is provided with a circumferential upright protrusion and an annular recess formed at the radially inner side of the circumferential upright protrusion. A supporting member for supporting the atomizer is adapted to be attached to the neck opening of the liquid container, and is provided with an annular inner wall adapted to be fittingly received by the annular recess of the flange, an intermediate wall adapted to hold the circumferential upright protrusion of the flange and an annular outer wall for stabilizing the attaching of the supporting member.

7 Claims, 8 Drawing Figures

CONSTRUCTION FOR SUPPORTING ATOMIZING MEANS OF MANUALLY OPERABLE ATOMIZER

BACKGROUND OF THE INVENTION

The present invention relates to a construction for supporting the atomizing means of a manually operable atomizer and, more particularly, to a construction capable of stably holding the atomizing means.

Conventionally, for securing the atomizing means to a liquid container, the atomizing means is placed such that an outwardly extending flange formed on the cylinder thereof rests on the neck opening brim of the container, and, then, a holding sleeve is placed so as to cooperate with the neck opening brim of the container in cramping the flange therebetween.

According to this arrangement, the diameter of the neck opening of the container is preferably made small, because a depression of the atomizing head for causing a pumping action imparts a large force on the flange, so as to deflect the latter downwardly. Namely, when the diameter of the neck opening is large, the support of the atomizing means is inconveniently rendered unstable, so as to hinder the smooth depression of the atomizing head, and shortly causes a leakage of the liquid through the attaching portion of the atomizing means.

For this reason, it is recommended to make the diameter of the neck opening small. However, in case of so-called turnable or reversible atomizer adapted to be used in the right and upside-down postures, the diameter of the stem portion has to be large because it has to accomodate two liquid suction pipes, one for ascending and one for descending, so that the diameter of the neck opening cannot be made small.

Consequently, from the view points of structure and installation of the atomizing means, it has been desired to make the diameter of the neck opening of the container as large as possible, while overcoming the aforementioned drawbacks of the prior arts.

Conventionally, the liquid containers are made of plastics. However, for facilitating the plating or printing on the surface of the container, the container is preferably made of a metal, because the metal affords an easy plating and printing thereon, over the plastics. However, as compared with the plastics, the metallic material makes it difficult to form in the neck opening the thread for holding the atomizing means. This gives a rise to a demand for a supporting means which can support the atomizing means stably on the liquid container, even when the latter is made of a metal.

OBJECT OF THE INVENTION

It is therefore an object of the invention to stably support the atomizing means of a manually operable atomizer, even with a large diameter of the neck opening of liquid container, and to ensure the smooth atomizing operation.

It is another object of the invention to facilitate the separation of the atomizing means from a holding member for holding the latter on the neck opening of the container, and to facilitate the attaching and detaching of the atomizing means to and from the liquid container.

It is still another object of the invention to facilitate the attaching and detaching of the atomizing means to and from the liquid container, even when the container is made of a metal.

DESCRIPTION OF THE PREFERRED EMBODIMENTS

Figure 1A:
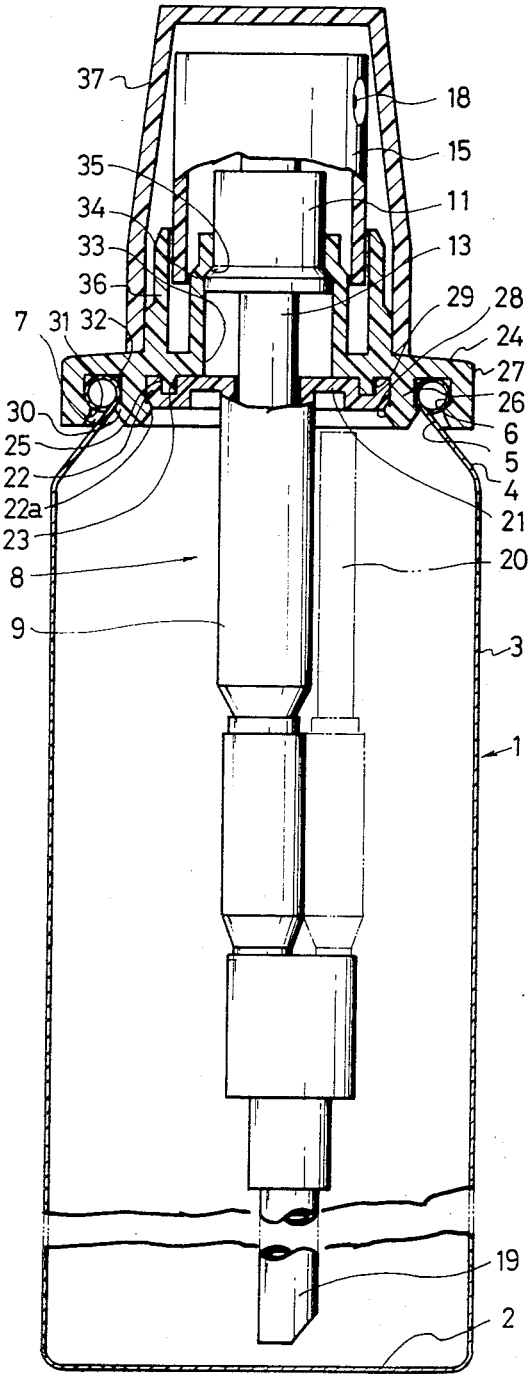
FIG. 1A is a sectional view of a manually operable atomizer having a construction of the invention for supporting the atomizing means.
Figure 1B:
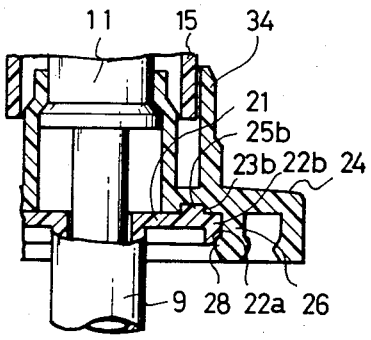
FIG. 1B is a sectional view of an essential part of a modification of the supporting construction.
Figure 2:
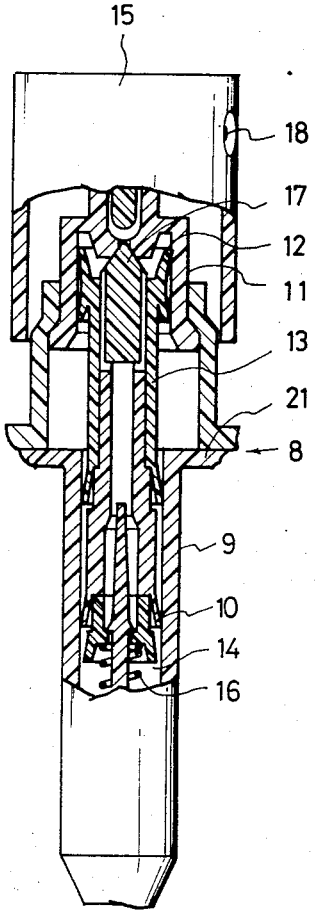
FIG. 2 is a schematic sectional view of atomizing means.

Referring first to FIGS. 1A and 1B and FIG. 2 showing a construction of the first embodiment for supporting the atomizing means, a liquid container 1, made of a metal, has a bottom wall 2, barrel portion 3, tapered shoulder portion 4 and a neck opening portion 5 of a smaller diameter than the barrel portion, which are arranged in the mentioned order from the lower side to the upper side of the container 1. The upper end edge portion of the neck opening is curled to have a circular cross-section so as to form a circumferential brim 6. Between the brim 6 and the shoulder portion 4, formed is a circumferential recess 7.

The atomizing means 8 has a lower portion received by the container 1 through the neck opening portion 5 of the latter, while the upper portion of the atomizing means 8 is supported by and held on the neck opening portion 5, through a medium of a later-mentioned supporting member 24.

Although the atomizing means 8 in this embodiment is described to have two pressurizing chambers of different diameters, i.e. a small-diameter pressurizing chamber and a large-diameter pressurizing chamber, the invention is equally applicable to the atomizing means having only one pressurizing chamber.

Thus, the atomizing means 8 of this embodiment has a first pressurizing chamber section constituted by a small-diameter cylinder 9 and a small-diameter piston 10, as well as a second pressurizing chamber section constituted by a large-diameter cylinder 11 and a large-diameter piston 12. The first and the second pressurizing chamber sections are in communication with each other through a tubular plunger 13, and in combination forms a pressurizing chamber 14.

As an atomizing head 15 is depressed overcoming the force of a spring 16, the liquid in the pressurizing chamber 14 is pressurized and forcibly opens the atomizing valve 17, so as to be atomized through a nozzle 18 mounted in the atomizing head 15. As the atomizing head 15 is released from the depressing force, the small-diameter piston 10 and the large-diameter piston 12 are returned to the original positions by the force of the spring 16, so that the liquid is sucked up, from the container 1 into the pressurizing chamber 14 through a suction pipe 19 which leads to a suction port of the pressurizing chamber 14.

If the atomizer is a turnable or reversible one which can be used in both of right and upside-down postures, another suction pipe 20*a* as illustrated by two-dots-and-dash line in FIG. 1A or a three-way valve is installed. In such a case, the lower portion of the atomizing means 8 inevitably has a large diameter, so that the neck opening portion 5 has to have a correspondingly large diameter. In this arrangement, it is a critical requisite to stably support the atomizing means.

A flange 21 is formed at the upper end portion of the small-diameter cylinder 9 of the atomizing means 8, so as to extend laterally from the latter. The flange 21 is turned to provide an outermost circumferential upright protrusion 22 which defines, at its inner side wall, an annular recess 23. A retaining surface 22*a* is formed in the lower portion of the outer peripheral surface of the upright protrusion 22.

The supporting member for supporting the atomizing means 8 is placed on the neck opening portion 5. The supporting member 24 is provided with an annular inner wall 25, an annular intermediate wall 26 and an annular outer wall 27. The inner peripheral wall 25 is closely fitted to the annular recess 23 of the flange 21, while the upright circumferential protrusion 22 of the flange 21 is closely received by the recess formed between the inner wall 25 and the intermediate wall 26. In this condition, the retaining surface 22*a* of the upright circumferential protrusion 22 is engaged and retained by an annular retaining portion 28 formed at the inner lower part of the intermediate wall 26.

Further, a protrusion 29 formed at the inside of the upright circumferential protrusion 22 is abutted by the annular inner wall 25, so that the flange 21 is rigidly connected to the supporting member 24.

The supporting member 24 is stably held on the neck opening 5, because the circumferential brim 6 of the neck opening is closely received by the annular recess formed between the intermediate and outer annular walls 26, 27. The supporting member 24 is strongly secured to the neck opening portion 5, due to an engagement of an annular retaining section 30 formed at the outer lower part of the intermediate wall 26 with the inner lower part of the circumferential brim 6, and due to an engagement of an annular retaining section 31 formed at the inner lower part of the annular outer wall 27 with the outer lower part of the circumferential brim 6.

An "O" ring is disposed between the circumferential brim 6 and the base portion of the intermediate wall 26, so as to maintain a watertight seal at the joint surfaces of the supporting member 24 and the neck opening portion 5.

The upper part of the atomizing means 8 projects upwardly through the central bore 33 of the supporting member 24, and the large-diameter cylinder 11 of the atomizing means 8 is slidably held by a holding sleeve 34 which projects upwardly from the periphery of the central bore 33. The holding sleeve 34 is provided at its upper portion with a step 35 adapted to abut the projection formed at the lower end of the large-diameter cylinder 11, thereby to limit the upward movement of the large-diameter cylinder 11. An outer sleeve 36 rises from the portion of the upper surface of the supporting member 24 around the holding sleeve 34, and is detachably engaged by the base portion of a cap 37 which covers the atomizing head 15.

FIG. 1B shows a modification of the construction for supporting the atomizing means. In this modification, an annular groove 23*b* is provided in the supporting member 24, in place of the inner annular wall 25, while a circumferential wall 25*b* adapted to be received by the annular groove 23*b* is formed on the flange 21.

That is, in this modification, the annular recess 23 and the inner annular wall 25 of the embodiment as shown in FIG. 1 are reversed. At the same time, the upright circumferential protrusion 22*b* of the flange 21 projects downward, such that the retaining surface 22*a* is engaged and retained by the annular retaining section 28 of the intermediate wall 26. Further, the upper part of the circumferential wall 25*b* is formed as a projecting retaining portion, and the circumferential wall 25*b* engage a retaining portion formed in the annular recess 23, so that the atomizing means 8 is supported in quite a stable manner.

The above stated constructions for supporting the atomizing means 8 allows the diameter of the flange 21 for supporting the atomizing means 8 to be diminished, even when the neck opening portion 5 of the liquid container 1 has a large diameter. Since this flange 21 is held by the neck opening portion 5 of the container 1 through the medium of the supporting member 24, the atomizing means 8 is stably held even when the diameter of the neck opening portion 5 is large, and, at the same time, a smooth depression of the atomizing head 15 is ensured. Further, no leakage of the liquid is caused, because the flange 21 is never moved.

In addition, the atomizing means 8 can easily be attached to the container 1, by simply bringing the upright circumferential protrusion 22 or the annular recess 23 of the flange 21 into engagement with the cooperating annular inner wall 25 or the intermediate wall 26 of the supporting member 24. Thus, the atomizing means 8 is attached quite easily and secured in quite a stable manner.

For refilling the liquid container 1 with new liquid, the intermediate wall 26 or the annular outer wall 27 of the supporting member 24 is simply disengaged from the circumferential brim 6 of the neck opening 5. After refilling the container 1, the supporting member 24 is again secured to the container 1, by simply pressing the same onto the circumferential brim 6 of the container 1.

Since the liquid container 1 is made of a metal, the outer edge of the neck opening portion 5 can easily be curled to form a brim 6, so as to afford an easy engagement of the neck opening portion 5 with the retaining portion of the supporting member.

Further, the metallic material of the liquid container allows an easy painting thereon, so that the atomizer of the invention can have an appearance similar to that of ordinary aerosol type atomizer having a liquid container made of a metal.

Figure 3:
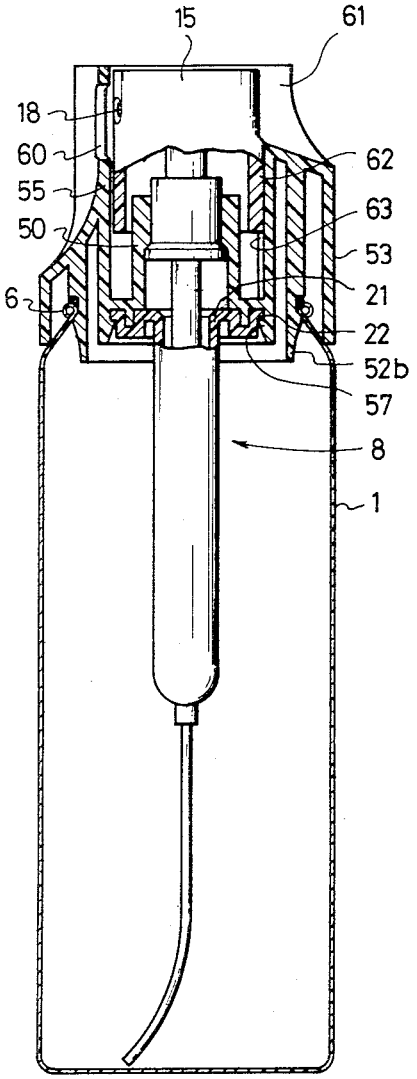
FIG. 3 is a sectional view of a manually operable atomizer having a construction, which is a second embodiment of the invention, for supporting the atomizing means.
Figure 4:
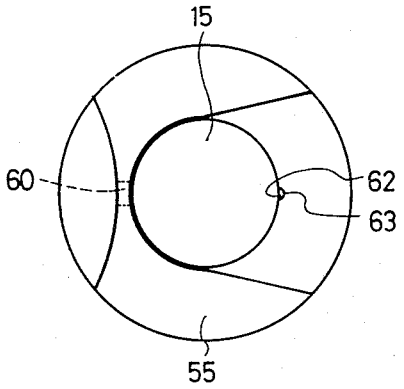
FIG. 4 is a plan view of the atomizer as shown in FIG. 3.
Figure 5:
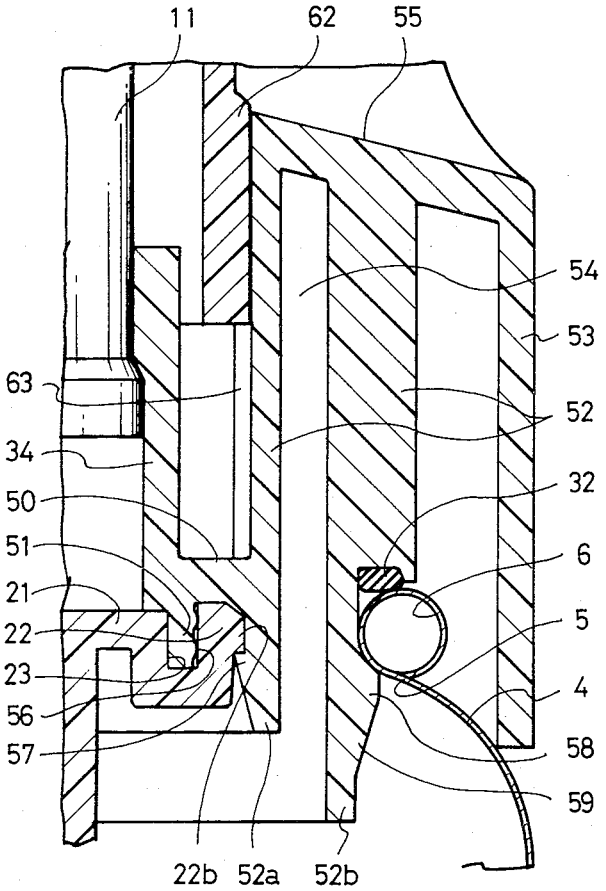
FIG. 5 is an enlarged view of an essential part of the atomizer as shown in FIG. 3.

Hereinafter, a second embodiment of the invention will be described with specific reference to FIGS. 3 to 5. In this embodiment, the supporting member 24 and the cap of the first embodiment are made unitary with each other, so as to form a supporting member 50. The flange 21 of the atomizing means 8 has, similarly to that of the first embodiment, a circumferential upright protrusion 22 and an annular recess 23. However, the retaining section 22*b* of the circumferential upright protrusion 22 is formed on the mid portion of the latter 22.

As is in the first embodiment, the supporting member 50 has an annular inner wall 51, intermediate wall 52 and an outer wall 53. However, in this embodiment, the intermediate wall 52 has an inner section 52*a* and an outer section 52*b* with an intermediate recess 54 formed therebetween for reducing the weight. At the same time, the intermediate wall 52 is extended upwardly, so as to form a cap portion 55 which covers the atomizing head 15.

The annular inner wall 51 is provided on its outer peripheral surface with an annular protrusion 56 for closely contacting the circumferential upright protrusion 22. An annular retaining section 57 is formed on the inner peripheral surface of the inner section 52*a*, for engagement with the retaining section 22*b*. Further, an annular retaining section 58 for engaging the brim 6 of the neck opening section 5 is formed on the outer peripheral surface of the outer section 52*b*. At the same time, the lower part of the outer periphery of the outer section 52*b* is tapered as at 59, so as to facilitate the attaching of the supporting member 50 to the neck opening portion 5 of the container. The outer wall 53 is positioned apart from the brim 6 of the neck opening portion 5, and abuts at its lower end the shoulder portion 4 of the container 1, thereby to stabilize the supporting member 50 on the container 1.

The aforementioned cap portion 55 is provided at its portion confronting the nozzle 18 of the atomizer head 15 with a window 60, as well as an opened recess 61 which affords the depression of the atomizing head 15. Further, a vertical linear protrusion 62 is formed on the atomizing head 15, while a guide groove for slidingly guiding the linear protrusion 62 is formed in the inner peripheral wall 52 at the upper part of the latter, so as to prevent the atomizing head 15 from rotating, thereby to keep the window 60 in alignment with the nozzle 18.

Needless to say, the arrangement of the guiding groove 63 and the linear protrusion 62 may be reversed.

Other portions of this embodiment than described above are identical to those of the first embodiment. Thus, the atomizing means 8 is stably held by the supporting member 50, in quite a stable manner. Also, the attaching of the atomizing head to the liquid container can be made quite easily.

Figure 6:
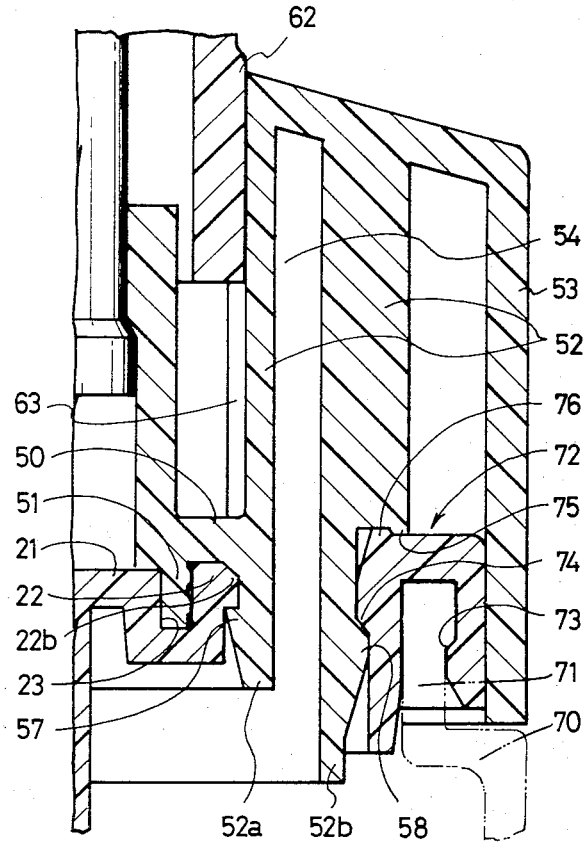
FIG. 6 is a sectional view of a manually operable atomizer incorporating a third embodiment of the invention.

FIG. 6 shows a third embodiment of the invention. In this embodiment, briefly, a liquid container 70 made of a plastic is substituted for the liquid container of the second embodiment. The neck opening section 71 has a cylindrical shape having a straight generating line. An annular auxiliary member 72 made of a plastic is secured to the neck opening 71, so as to partially cover the inner and outer peripheral surfaces of the neck opening portion 71. The auxiliary member 72 has a step 73 which firmly engages the step of the neck opening portion 71. An annular retaining section 74 is formed on the inner peripheral wall of the auxiliary member 72. This annular retaining section 74 is adapted to engage the annular retaining section 58 of the intermediate wall 52 of the supporting member 50. The outer wall 53 contacts at its lower inner peripheral surface the outer peripheral wall of the auxiliary member 72, thereby to stably hold the supporting member 50. The auxiliary member 72 is further provided at its upper part with an annular protrusion 76 adapted for engagement with the retaining section 75 of the intermediate wall 52.

Other parts than mentioned above are identical to those of the second embodiment. Thus, according to the invention, the atomizing means can be stably supported on the liquid container 70, even when the latter is made of a plastic, by an incorporation of an auxiliary member 72.

Figure 7:
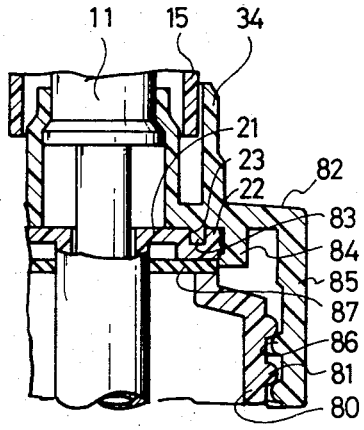
FIG. 7 is a sectional view of an essential part of a fourth embodiment of the invention.

FIG. 7 shows a fourth embodiment of the invention. In this embodiment, the liquid container is made of a plastic, as is the case of the third embodiment. Further, the outer periphery of the neck opening portion 80 is threaded as at 81.

The supporting member 80 has an annular inner wall 83, an intermediate wall 84 and an annular outer wall 85. A thread 86 for engaging the thread 81 of the neck opening portion is formed in the inner peripheral wall of the outer annular wall 85. The flange 21 of the atomizing means 8 is secured to the supporting member 82, with its circumferential upright protrusion 22 or the annular recess 23 fittingly engaged by the inner annular wall 83 or the intermediate wall 84 of the supporting member 82. The lower surface of the flange 21 abuts the upper end edge of the neck opening portion 80, through a medium of a sealing member 87.

Consequently, the supporting member 82 is rigidly connected to the container, through a screwing engagement of the thread 86 with the thread 81 of the neck opening portion, and the flange 21 is stably held also by the neck opening portion 80, so as to further stabilize the support of the atomizing means 8.

The aforementioned modification as shown in FIG. 1B can equally be applied to the second to fourth embodiments, as well as to the first embodiment.

What is claimed is:

1. In a manually operable atomizer having an atomizing means supported by the neck opening portion of a liquid container and adapted to perform an atomizing action, a pressurizing chamber constituted by a cylinder and a piston included by said atomizing means and adapted to perform a pumping action, an atomizing head by means of which said piston is depressed to perform said pumping action and a nozzle through which the pressurized liquid in said pressurizing chamber is atomized; a construction for supporting said atomizing means comprising: a flange extending outwardly from an upper portion of said cylinder; a supporting member adapted to support said atomizing means through the medium of said flange, said supporting member having retaining means for engaging the edge of said neck opening portion of said container; a first annular wall projected from said supporting member; an annular recess formed in said flange adapted to fittingly receive said first annular wall; and a second annular wall projected from said supporting member surrounding said first annular wall, said second annular wall being provided in its lower outer peripheral surface with a first retaining section as said retaining means, the portion of said flange around said annular recess being turned to form a circumferential upright protrusion provided in its lower portion with a second retaining section, said second annular wall having in its lower inner peripheral surface a third retaining section adapted for engagement with said second retaining section.

2. A construction for supporting atomizing means as claimed in claim 1, wherein the lower portion of the outer periphery of said second annular wall is tapered, so as to facilitate the attaching of said supporting member to said liquid container.

3. A construction for supporting atomizing means as claimed in claim 1, wherein: a third annular wall is projected from said supporting member so as to surround said second annular wall; and said liquid container is made of a metal, the edge of said neck opening portion being curled to form a brim adapted to engage a fourth retaining section formed at a lower portion of said third annular wall.

4. A construction for supporting atomizing means as claimed in claim 1, characterized by further comprising a guide sleeve disposed above said first annular wall for guiding the upward and downward movement of said atomizing head.

5. A construction for supporting atomizing means as claimed in claim 3, further comprising: an auxiliary member adapted to be fitted to said neck opening portion of said liquid container so as to cover the inner and outer peripheral surfaces of said neck opening portion, said auxiliary member having a fifth retaining portion adapted to engage said first retaining section of said second annular wall projected from said supporting member so as to surround said second annular wall, said third annular wall being provided with an abutting surface adapted to abut the lower outer peripheral portion of said auxiliary member.

6. A construction for supporting atomizing means as claimed in claim 1, characterized by further comprising a cap secured to said supporting member and adapted to cover said atomizing head, said cap having a notched part for allowing the depression of said atomizing head and a window confronting said nozzle, wherein one of said atomizing head and said supporting member has a linear protrusion, while the other has a guide groove for slidingly guiding the movement of said linear protrusion, so as to hold the nozzle of said atomizing head and said window of said cap in alignment with each other.

7. A construction for supporting atomizing means as claimed in claim 1, wherein: said container is made of a plastic, said neck opening portion being threaded at its outer peripheral surface; a third annular wall is projected from said supporting member so as to surround said second annular wall; said third annular wall of said supporting member having a thread for screwing engagement with the thread of said neck opening portion; said flange being adapted to be placed on the upper end of said neck opening portion.

* * * * *